US005526986A

United States Patent [19]

Padgett et al.

[11] Patent Number: 5,526,986

[45] Date of Patent: Jun. 18, 1996

[54] WATERBASE VOLTAGE BLOCK AND PAINT VALVE

[75] Inventors: David Padgett, Carlsbad, Calif.; Robert J. Lind, Robbinsdale, Minn.

[73] Assignee: Graco Inc, Minneapolis, Minn.

[21] Appl. No.: 409,284

[22] Filed: Mar. 23, 1995

Related U.S. Application Data

[63] Continuation-in-part of Ser. No. 332,714, Nov. 1, 1994, abandoned.

[51] Int. Cl.[6] ..... B05B 5/00

[52] U.S. Cl. ..... 239/690; 239/691; 239/708; 118/629

[58] Field of Search ..... 239/690, 691, 239/708; 251/63.4, 343; 118/300, 621, 627, 629; 361/217, 218

[56] References Cited

U.S. PATENT DOCUMENTS

| | | | |
|---|---|---|---|
| 2,916,576 | 12/1959 | Croskey et al. | 200/81.9 |
| 4,313,475 | 2/1982 | Wiggins | 239/691 |
| 4,467,461 | 8/1984 | Rice et al. | 367/70 |
| 4,581,559 | 4/1986 | Faure et al. | 313/147 |
| 4,887,770 | 12/1989 | Wacker et al. | 239/703 |
| 4,982,903 | 1/1991 | Jamison et al. | 239/708 |
| 5,083,711 | 1/1992 | Giroux et al. | 239/690 |
| 5,094,389 | 3/1992 | Giroux et al. | 239/690 |
| 5,152,466 | 10/1992 | Matushita et al. | 239/708 |
| 5,197,676 | 3/1993 | Konieczynski et al. | 239/691 |
| 5,326,031 | 7/1994 | Konieczynski | 239/3 |
| 5,341,990 | 8/1994 | Konieczynski et al. | 239/708 |

*Primary Examiner*—Andres Kashnikow
*Assistant Examiner*—Lisa Douglas
*Attorney, Agent, or Firm*—Douglas B. Farrow

[57] ABSTRACT

A voltage isolation device for controlling the flow of conductive liquid between a liquid supply source and a liquid destination source. The isolation device has an inlet connected to the supply source and has a yoke slide valve positionable along a pair of rods; one of the rods engages a slideable tube at the inlet to provide a liquid seal and the yoke slide valve may be positionable to slide the tube away from the rod to thereby provide a flow path for liquid through the tube and out the slide valve. A pair of seal assemblies each having axially spaced apart seals have formed sealing areas containing a non-conductive seal liquid which is capable of dissolving the conductive liquids being utilized. A scheme is provided to route arcs which result when the charged fluid is connected to the grounded fluid so as to locate the arc away from parts which could be damaged by it.

17 Claims, 8 Drawing Sheets

WATERBASE VOLTAGE BLOCK AND PAINT VALVE

RELATED APPLICATIONS

This application is a continuation-in-part of U.S. Ser. No. 08/332,714, filed Nov. 1, 1994 now abandoned.

BACKGROUND OF THE INVENTION

The present invention relates to an apparatus for delivering a conductive liquid to an apparatus having an electrical voltage charge. More particularly, the invention relates to an apparatus for spraying conductive paint under electrostatic voltage spraying conditions.

It is well known that the utilization of electrostatic voltage assists in the spraying of articles and greatly improves the efficiency of the overall spraying system. When paint is sprayed in the presence of an electrostatic field, the paint spray particles pick up electrostatic voltage charges and are, therefore, attracted readily to a grounded article.

This electrostatic charging process greatly increases the number of paint spray particles which become applied to the article thereby greatly reducing the amount of paint overspray which would otherwise pass beyond the article.

A particular problem results from attempting to spray water-base coating materials in an electrostatically-charged spraying system. The problem arises because the water-base component is conductive to a greater or lesser degree; and therefore, the electrostatic voltages can be directed into the liquid column at the point of discharge into spray particles and the liquid column itself can form a conductive path back to the point of origin of the liquid. In this situation, all of the components in the liquid coating delivery system can become voltage charged and can present a hazard in the work environment. One solution to the problem is to voltage isolate the entire spraying system, preventing any user from coming into contact with the system components. Another solution is to voltage isolate certain components of the liquid delivery system, particularly those components to which a user might become exposed. A further solution is to voltage isolate the liquid delivery column to limit the extent to which the liquid column can become voltage charged, to thereby prevent all components upstream from the voltage isolation point from becoming voltage charged. The present invention relates to this latter approach to improving the safety and utilization of electrostatic spraying systems in connection with conductive liquid coating materials.

It is a principal object of the present invention to provide a voltage isolation device in the liquid flow path of an electrostatic coating system to isolate electrostatic voltage charge accumulation.

It is another object of the present invention to provide a voltage block or voltage isolation device for connecting a grounded liquid supply system to a voltage-charged liquid spraying system.

SUMMARY OF THE INVENTION

A voltage isolation device for controlling the flow of conductive liquid materials between a liquid supply source and a liquid accumulator. The voltage isolation device has a slide valve controllably positioned by an air cylinder into each of two operable positions. The slide valve includes a yoke which is slideable over a non-conductive rod, and a non-conductive tube abutting one end of the non-conductive rod. The yoke is slideable along the non-conductive rod over a considerable portion of its length and is also slideable over a portion of the non-conductive tube abutting the end of the rod. The yoke is engageable against a shoulder on the tube to slideably move the tube away from contact with the end of the rod and into flow contact with a passageway through the yoke.

In the preferred embodiment of the instant invention, a pair of seal assemblies are spaced apart and produce a flow space therebetween to allow fluid to flow into the tube when the tube is pushed away from the rod. Each seal assembly has a pair of axially spaced apart seals which form a sealing area therebetween. The sealing area is an annular passage which is filled with a material such as TSL (throat seal liquid) sold by Graco Inc., the assignee of the instant invention. Such TSL is primarily comprised of phosphoric acid tricresyl ester.

An inlet and an outlet passage are provided for each sealing area and a pump is provided which circulates the throat seal liquid first through one seal area and then the other and thence back to a reservoir. The pump is actuated to pump a fixed amount of fluid with each stroke of the air cylinder in order to circulate the fluid through the system.

An arc bypass device serves to control the resulting arc which occurs when the charged fluid section comes near contact with the grounded section. This serves to direct the arc away from portions of the apparatus which could be harmed by such arcs such as seals. The conductive member contacts the fluid in the yoke and leads to a contact point on the outside of the yoke away from the rod and the seals associated therewith.

A similar ground contact in the tube fluid section leads to a ground probe attached to the tube wherein the ground probe comes into proximity with the contact on the yoke as the yoke approaches the first position connecting the fluid source and the charged fluid.

These improvements are intended to provide a substantial improvement in cycle life before servicing is required compared to the prior art devices.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
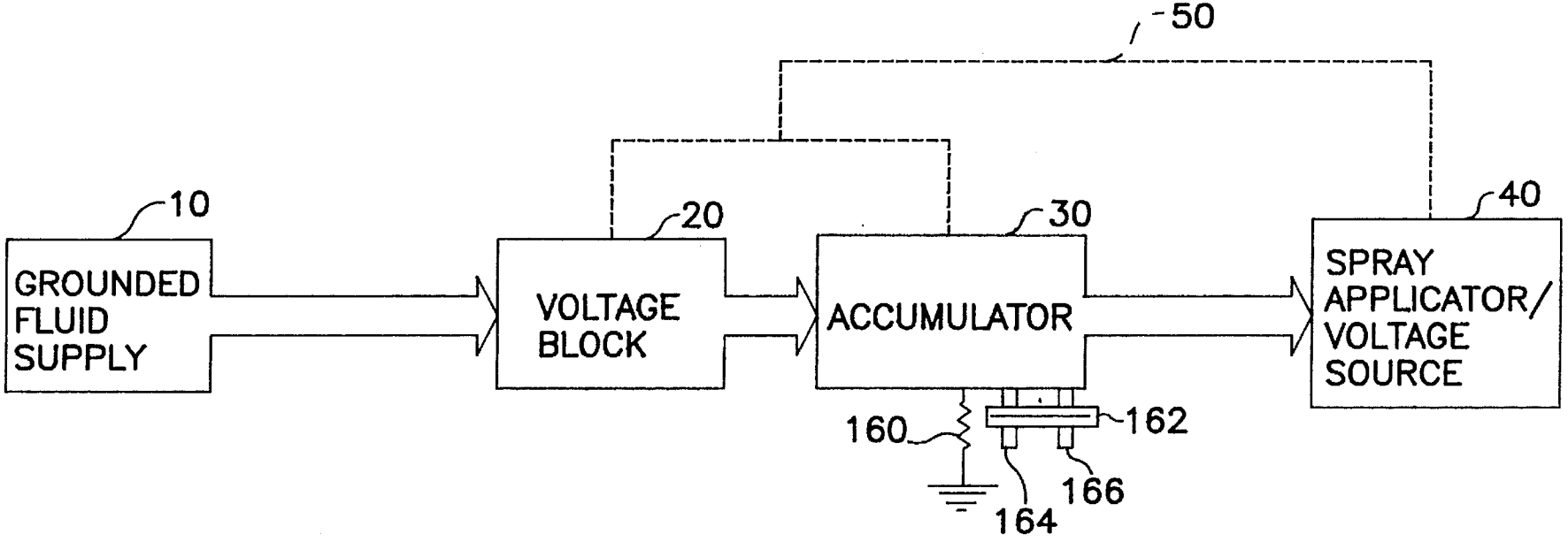
FIG. 1 shows a flow diagram of an electrostatic system incorporating the invention.

Referring first to FIG. 1, there is shown a simplified block diagram of an electrostatic spraying system of the type useful for spraying conductive coating liquids. A supply reservoir 10 of the liquid to be sprayed is typically confined in a container which is at electrical neutral or ground potential. The liquid in supply container 10 is delivered to a voltage block 20, which is further described herein, for the purpose of creating a voltage isolation between the grounded container 10 and the downstream liquid delivery components. The voltage block 20 delivers the liquid to an accumulator 30 which may become charged to an elevated voltage potential. Accumulator 30 delivers the liquid to a spray applicator 40, wherein the spray applicator 40 may have either a built-in voltage source or may be associated or connected to a voltage source. The voltage source is typically an electrostatic voltage source, thereby providing an electrostatic voltage in the range of 20–100 kilovolts (20 KV–100 KV) which is of sufficient magnitude to create an electrostatic field through which the sprayed particles must pass. The spray applicator 40 is typically controlled and triggered by air circuits, and the dotted lines 50 indicate air logic control over the voltage block 20 and accumulator 30 via the same or similar air circuits. The use of air circuits and air logic controls for controlling the triggering of spray applicators and various other liquid flow devices is well known in the art and need not be further described herein however accumulator 30 may be provided with upper and lower limit switches 164 and 166 which can be adjusted via bracket 162 to signal logic 50 when to cycle. This allows varying of the batch size to suit the parts being painted.

Electrostatic voltage supplies and the techniques for delivering electrostatic voltages to spray applicators are well known in the art and need not be further described herein.

Figure 2A:
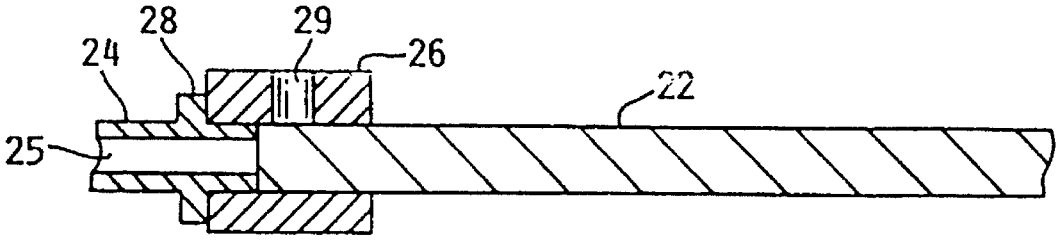
FIGS. 2A, 2B and 2C show simplified drawings of the invention.
Figure 2B:
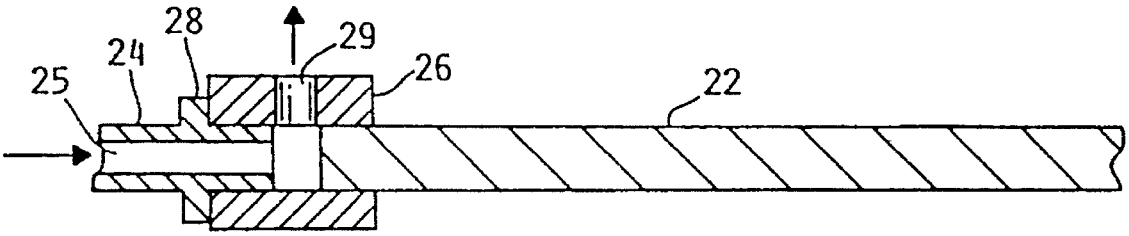
Figure 2C:
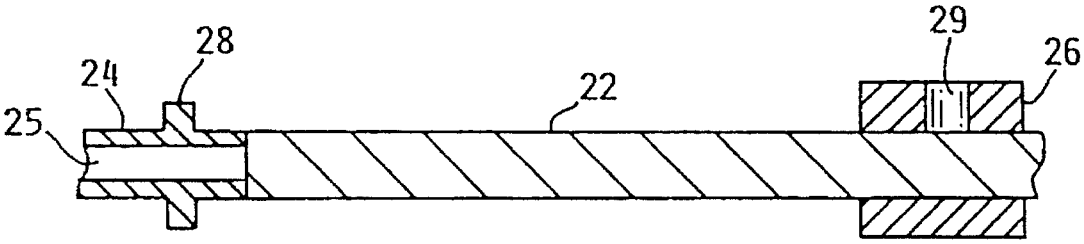

FIGS. 2A, 2B and 2C show simplified diagrams to illustrate the present invention. A non-conductive rod 22 is abutted against the end of a liquid supply tube 24 as shown in FIG. 2A. A slideable yoke 26 is sealably fitted over rod 22 and the end portion of tube 24. Yoke 26 abuts against a shoulder 28 which is positioned proximate the end of tube 24. Yoke 26 has a flow path 29 which is discontinuously positioned relative to tubular flow path 25 in FIG. 2A. FIG. 2B is one operative position, which shows yoke flow path 29 in liquid flow alignment with tubular flow path 25, which is accomplished by moving yoke 26 leftwardly against shoulder 28 to slide tube 24 to the left to thereby create the flow path alignment. FIG. 2C is a second operative position, which shows yolk 26 moved rightwardly along non-conductive rod 22 to become longitudinally displaced from tube 24 and to thereby become isolated from tube 24. The spaced position of flow path 29 from flow path 25, as shown in FIG. 2C, provides a voltage isolation between conductive liquid which might be contained within either of the flow paths 25 or 29. In operation, the liquid flow direction is shown by the arrows in FIG. 2B, wherein liquid from a grounded supply source enters tube 24 and flows outwardly through flow path 29 of yoke 26 when the voltage block valve is in the position shown.

Figure 3:
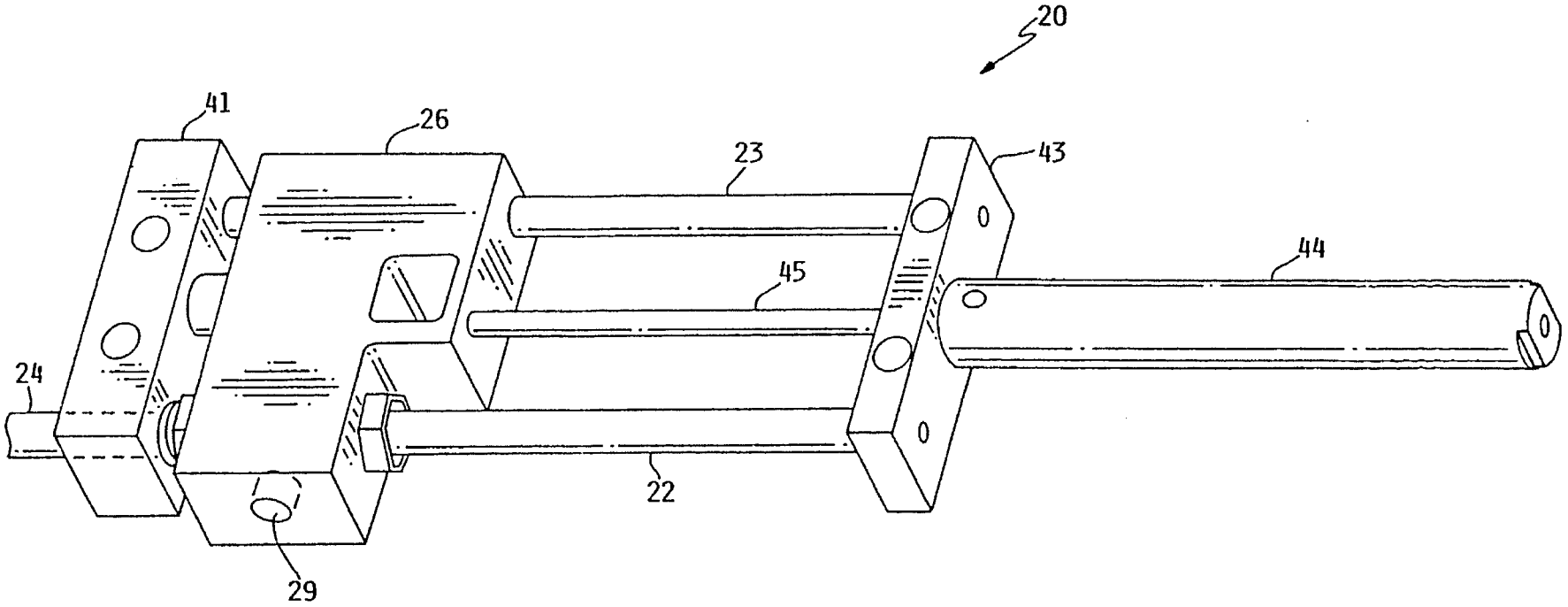
FIG. 3 shows an isometric elevation view of the invention.

FIG. 3 shows one form of construction of the voltage block 20 in isometric view. An inlet tube 24 is connected to a support block 41, and a flow passage passes through support block 41. A yoke 26 is slideably guided along non-conductive rod 22 and guide rod 23 over a path which extends between support block 41 and support block 43. An air cylinder 44 is connected to support block 43, and air cylinder 44 has an extensible piston rod 45 extending therefrom. Piston rod 45 is affixed to yoke 26; the extension and retraction of piston rod 45 causes a corresponding slideable movement of yoke 26 over the two rods 22, 23. Yoke 26 has an outlet flow passage 29 which corresponds to the same component as shown in FIGS. 2A–2C. In all cases, like reference numbers refer to the same or similarly functioning components.

Figure 4A:
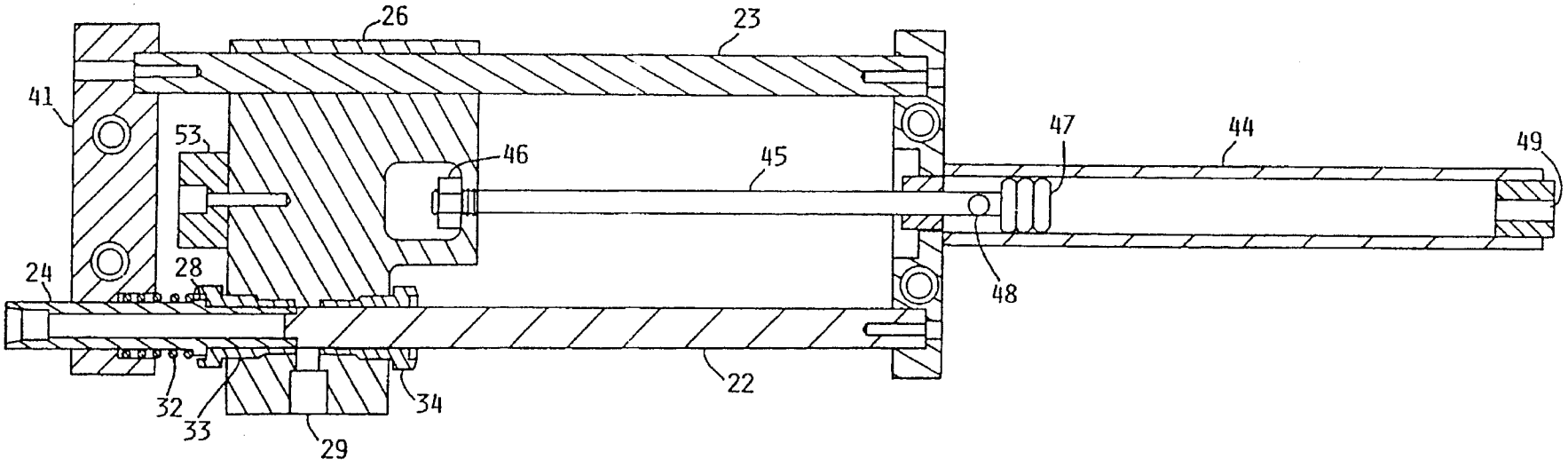
FIG. 4A shows a cross-section view of the invention of FIG. 3, in the position corresponding to FIG. 2A.

FIG. 4A shows a cross-sectional view of the voltage block 20 of FIG. 3 in a non-operative position. Tube 24 is slideably movable within support block 41, but is biased rightwardly by a compression spring 32 which is engaged between shoulder 28 and support block 41. Tube 24 is also slideable within a liquid seal 33 which is affixed to yoke 26. A second liquid seal 34 is also affixed to yoke 26 and is slideable over non-conductive rod 22. Yoke 26 is also slideably mounted over guide rod 23, which serves as a guide to permit the free longitudinal movement of yoke 26. Piston rod 45 is affixed to yoke 26 and a locknut 46 secures piston rod 45 to yoke 26. Piston rod 45 is also affixed to a piston 47 which is slideably positionable within an air cylinder 44. Air cylinder 44 has an air inlet/exhaust 48 proximate one of its ends and an air inlet/exhaust 49 proximate its other end. Pressurized air may be admitted into either of the inlets 48, 49 while the other inlet is relieved to atmospheric pressure. This permits pressurized air to operatively slide piston 47 in either direction within cylinder 44, and thereby to cause piston rod 45 to either retract into air cylinder 44 or extend outwardly from cylinder 44. A rubber stop 53 is mounted to yoke 26 to provide a stop limit to the longitudinal movement of yoke 26. In the position shown in FIG. 4A, yoke 26 is abutted against stop 28 of tube 24; and rod 22 is abutted against and seals the end of tube 24. Outlet 29 from yoke 26 is blocked from flow communication with tube 24.

Figure 4B:
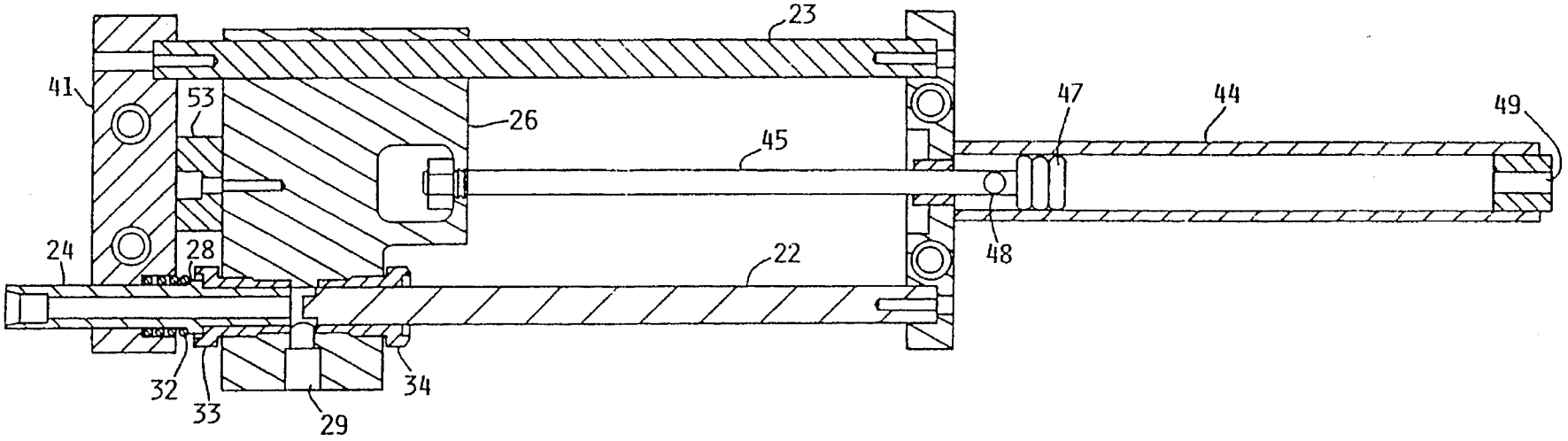
FIG. 4B shows a cross-section view of the invention of FIG. 3, in the position as shown in FIG. 2B.

FIG. 4B shows the cross-sectional view of voltage block 20 in an operative position corresponding to the simplified diagram of FIG. 2B. In this position, piston rod 45 has been extended from cylinder 44 and has thereby caused yoke 26 to move leftward until stop 53 contacts support block 41. The leftward movement of yoke 26 causes tube 24 to also move leftwardly due to the contact of the yoke 26 sealing member 33 against shoulder 28. This leftward movement of tube 24 overcomes the compression spring force of spring 32 and permits a liquid flow path to be formed between tube 24 and outlet 29 of yoke 26.

Figure 4C:
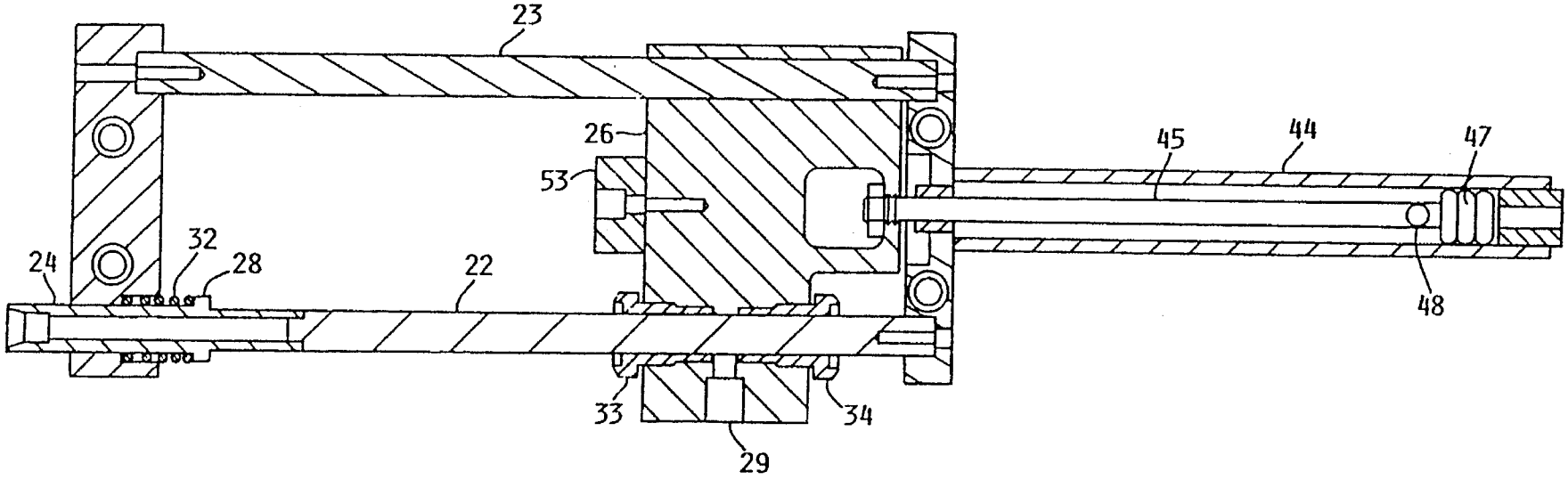
FIG. 4C shows a cross-section view of the invention of FIG. 3, in the position as shown in FIG. 2C.

FIG. 4C shows the voltage block 20 in an operative position corresponding to the position shown in the simplified diagram of FIG. 2C. In this position, piston rod 45 is wholly retracted into cylinder 44 thereby moving yoke 26 rightwardly over rods 22, 23. The rightward movement of yoke 26 releases the force against shoulder 28 of tube 24, and compression spring 32 thereby forces tube 28 to move rightwardly into sealing and closure contact with non-conductive rod 22. In the position shown in FIG. 4C, the liquid outlet 29 is isolated by a considerable distance from the liquid confined within tube 24. Therefore, any voltage charge accumulated in the liquid path connected to outlet 29 is wholly isolated from the liquid within tube 24. It is preferable that the spacing between support block 41 and support block 43 be at least approximately 12–14 inches. This construction should provide a separation of greater than about six inches between support block 41 and yoke 26 when the piston rod 45 is in its fully retracted position, which is sufficient to provide good voltage isolation between the conductive flow components.

In operation, the pressurized air which is admitted into cylinder 44 is controllable by the spray applicator trigger mechanism through air circuits 50. Whenever the spray applicator becomes triggered for spraying, pressurized air is admitted into inlet 48 of cylinder 44 thereby forcing piston 47 rightwardly within cylinder 44 and moving yoke 26 to its full rightward position. The triggering of the spray applicator 40 also causes the high voltage to be applied to the spray applicator and causes liquid from accumulator 30 to pass into the spray applicator 40. As this liquid is sprayed, the electrostatic voltage may conductively pass into accumulator 30 but is effectively isolated from inlet tube 24 of voltage block 20. Conductive liquid may pass as far rearwardly as into the outlet 29 of yoke 26 but non-conductive rod 22 provides a voltage barrier from any further conductive contact. Whenever the spray applicator is disengaged, the air cylinder is activated so as to move piston rod 45 leftwardly to cause yoke 26 to abut against stop 28 of tube 24. This permits liquid to flow from the liquid source into accumulator 40 during a time interval when no voltage is being applied to spray applicator 40.

Figure 5:
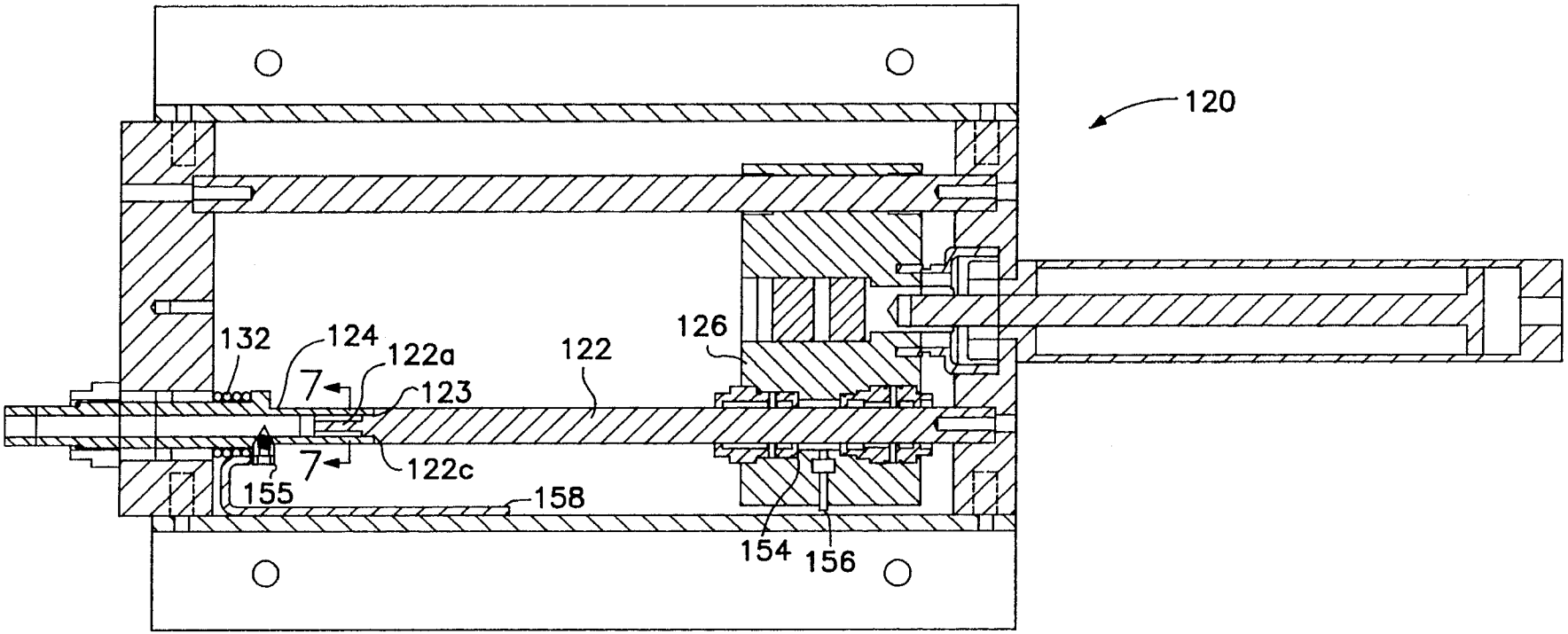
FIG. 5 is a cross sectional view of another embodiment of the instant invention taken along a cross section similar to that of FIGS. 4*a* through 4*c*.
Figure 7:
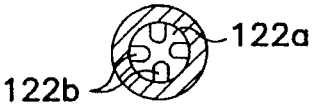
FIG. 7 is a sectional view taken along line 7–7 of FIG. 5.

Turning to FIG. 5, the preferred embodiment of the instant invention, generally designated 120 is comprised of rod 122 and inlet tube 124. As shown in FIG. 7, the distal end 122*a* of rod 122 has in the preferred embodiment four axial passages 122*b* formed therein to allow fluid to pass therebetween when the shoulder 122*c* of rod 122 is separated from inlet 124. The outer diameter of distal end 122*a* is sized to be approximately the same as the inside diameter of inlet tube 124 to assure that the tube component remain substantially coaxial. 123 is located at the bottom end of distal end 122*a* where it joins the main full diameter portion of rod 122. 0-ring 123 serves to provide a seal when rod 122 and tube 124 are pressed together by spring 132.

Figure 6:
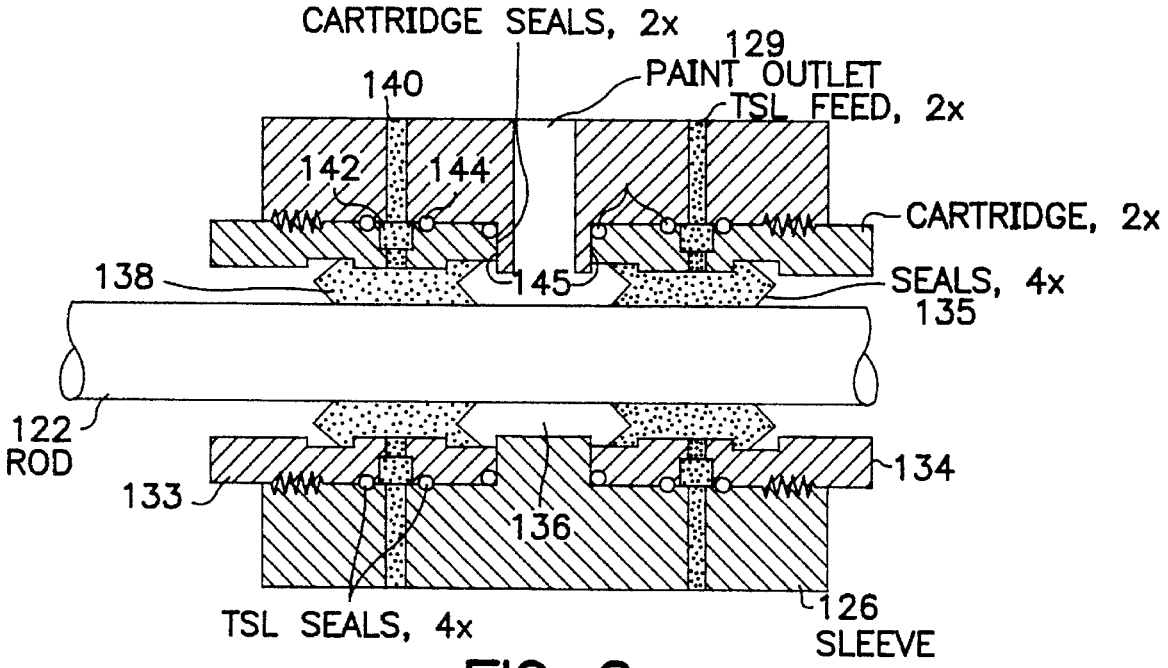
FIG. 6 is a detailed cross sectional view of the yoke.

Yoke 126 is shown in more detail in FIG. 6. Yoke 126 is provided with first and second seal assemblies 133 and 134. Each cartridge is threaded into sleeve 126 and carries a pair of V seals 135 wherein the V faces inwardly towards the flow space 136. Each seal space 138 is formed by a pair of the seals 135 and is fed by a feed passage 140 in yoke 136 which in turn connects with annular seal passage 142 in cartridges 133 and 134. 0-ring seals 144 serve to confine the liquid therein. A further 0-ring seal 144 may also be utilized at the bottom of the aperture containing cartridges 133 and 134 along with a TEFLON® gasket 145 where cartridges 133 and 134 bottom out.

Figure 8:
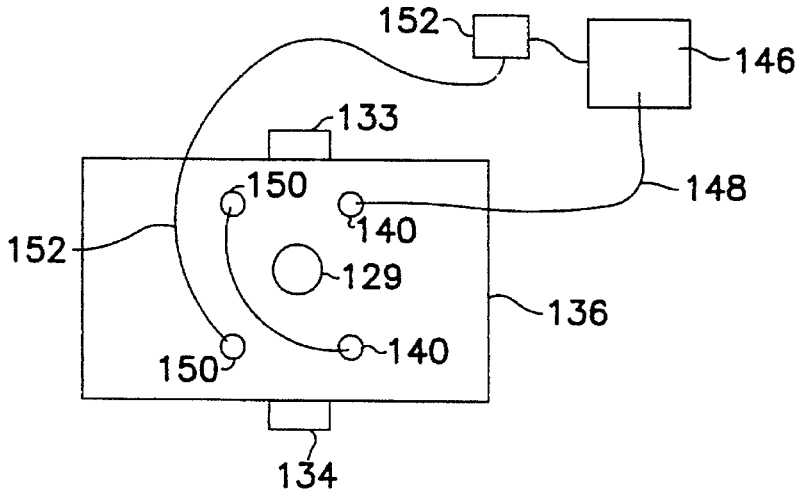
FIG. 8 is a schematic view showing the TSL circulation circuit.

FIG. 8 shows in schematic form the circulation of the TSL. A reservoir 146 is provided with an outlet line 148 which leads to first TSL inlet 140 whereupon the liquid circulates through first seal area 138 and hence outwardly through port 150 and thence through line 152 to port 140 of the other cartridge 134 and thence from the other outlet 150 to pump 152 and thence back to reservoir 146.

An arc bypass device serves to control the resulting arc which occurs when the charged fluid section comes near contact with the grounded section. A conductive member 154 contacts the fluid in the yoke 126 and leads to a contact point 156 on the outside of the yoke 126 away from the rod 122 and the seals associated therewith.

A similar ground contact 156 in the tube fluid section leads to a ground probe 158 attached to the tube wherein the ground probe 158 comes into proximity with the contact 156 on the yoke 126 as the yoke approaches the first position connecting the fluid source and the charged fluid.

FIG. 1 shows a bleed resistor 160 attached between ground and accumulator 30 (a part thereof which is contacted by charged conductive fluid) having in the preferred embodiment a value of about 3 gigohms. This allows all voltage to drain from the charged fluid after charging is stopped in about 5–6 seconds. This serves to help extend cycle life and provide a safer product.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A voltage isolation apparatus for controlling the flow of conductive liquids between a grounded liquid supply source and a liquid delivery device, comprising:

a) a housing having an inlet connected to said liquid supply source;

b) a tube slideable in said housing and connected to said inlet, said tube having a raised shoulder;

c) a first non-conductive rod positionable against said tube to form a liquid seal of said tube;

d) a yoke slideably mounted to said first rod and said tube, said yoke having a flow passage therethrough;

e) means for sliding said yoke between a first position contacting said raised shoulder wherein said tube is slideably moved to provide a flow path from said tube through said flow passage, and a second position wherein said yoke is remotely positioned from said tube to electrically isolate said grounded liquid supply source from said liquid delivery device; and f) a liquid delivery device connected to said yoke flow passage.

2. The apparatus of claim 1, further comprising a spring biasing means for urging said tube against said first rod.

3. The apparatus of claim 2, wherein said spring biasing means comprises a compression spring mounted between said housing and said raised shoulder.

4. The apparatus of claim 3, further comprising a second rod connected to said housing and aligned in parallel with said first non-conductive rod; and wherein said yoke is slideably mounted to both said first and second rods.

5. The apparatus of claim 4, wherein said means for sliding said yoke further comprises an air-operated piston connected to said yoke and said piston slideably mounted in an air cylinder connected to said housing.

6. The apparatus of claim 5, wherein said first and second rods have a length of at least six inches.

7. The voltage isolation apparatus of claim 1 wherein said liquid delivery device comprises:

an accumulator; and means for effectively adjusting the capacity of said accumulator.

8. The voltage isolation apparatus of claim 1 wherein said yoke further comprises:

a bottom surface, said first rod and said tube being slideable through said surface; and first and second seal assemblies spaced from one another and defining an annular flow space therebetween for containing said conductive liquid, each said seal assembly comprising a first and second axially spaced seals forming an annular sealing space therebetween, said annular sealing space containing a non-conductive solvent miscible with said conducting fluid.

9. The voltage isolation apparatus of claim 8 further comprising a reservoir for circulating said solvent from said reservoir, through said sealing spaces and back to said reservoir.

10. The voltage isolation apparatus of claim 9 further comprising:

at least one conductive element electrically communicating between said flow space and a point exterior of said yoke and remote from said conductive fluid; and means for providing an arc to ground from said conductive element when said yoke approaches said first position.

11. A voltage isolation apparatus for controlling the flow of conductive liquids between a liquid supply source and a liquid delivery source, comprising:

a) a housing having a first section with an inlet connected to said liquid supply source and having a second section;

b) at least two rods connected between said first and second sections, said rods positioning said second section spaced away from said first section;

c) a yoke slideably mounted on said rods, said yoke having a flow passage therein;

d) a tube slideably mounted in said first section and aligned in endwise relationship to one of said at least two rods, and a compression spring connected between said tube and said first section, said spring urging said tube into endwise abutting relationship to said one of said at least two rods;

e) a liquid flow conduit connected between said yoke flow passage and said delivery source; and f) means for sliding said yoke over said at least two rods between said first and second housing sections.

12. The apparatus of claim 11, wherein said tube further comprises a raised shoulder contacting said compression spring.

13. The apparatus of claim 12, wherein said means for sliding further comprises an air cylinder affixed to said housing second section and a movable piston in said air cylinder, and a piston rod connected between said piston and said yoke.

14. The apparatus of claim 13, further comprising liquid seals mounted in said yoke and against said tube and said endwise-aligned rod.

15. A voltage isolation apparatus for controlling the flow of conductive liquids between a liquid supply source and a liquid delivery device, comprising:

a) a housing having an inlet connected to said liquid supply source;

b) a tube slideable in said housing and connected to said inlet, said tube having a raised shoulder;

c) a first non-conductive rod positionable against said tube to form a liquid seal of said tube;

d) a yoke slideably mounted to said first rod and said tube, said yoke having a flow passage therethrough, said yoke further comprising:

i) a bottom surface, said first rod and said tube being slideable through said surface; and ii) first and second seal assemblies spaced from one another and defining an annular flow space therebetween for containing said conductive liquid, each said seal assembly comprising a first and second axially spaced seals forming an annular sealing space therebetween, said annular sealing space containing a non-conductive solvent miscible with said conducting fluid;

e) means for sliding said yoke between a first position contacting said raised shoulder wherein said tube is slideably moved to provide a flow path from said tube through said flow passage, and a second position wherein said yoke is remotely positioned from said tube to electrically isolate said grounded liquid supply source from said liquid delivery device; and f) said liquid delivery device being connected to said yoke flow passage.

16. A voltage isolation apparatus for controlling the flow of conductive liquids between a liquid supply source and a liquid delivery device, comprising:

a) a housing having an inlet connected to said liquid supply source;

b) a tube slideable in said housing and connected to said inlet, said tube having a raised shoulder;

c) a first non-conductive rod positionable against said tube to form a liquid seal of said tube;

d) a yoke slideably mounted to said first rod and said tube, said yoke having a flow passage therethrough;

e) means for sliding said yoke between a first position contacting said raised shoulder wherein said tube is slideably moved to provide a flow path from said tube through said flow passage, and a second position wherein said yoke is remotely positioned from said tube;

f) a liquid delivery device connected to said yoke flow passage;

g) at least one conductive element electrically communicating between a flow space and a point exterior of said yoke and remote from said conductive fluid; and h) means for providing an arc to ground from said conductive element when said yoke approaches said first position.

17. The voltage isolation apparatus of claim 16 further comprising a bleed resistor electrically connected to said liquid delivery device.

* * * * *